United States Patent [19]

Warheit

[11] Patent Number: 4,893,530

[45] **Date of Patent: * Jan. 16, 1990**

[54] PLIER-TYPE TOOL

[76] Inventor: William A. Warheit, 121 Iroquois Dr., Butler, Pa. 16001

[ * ] Notice: The portion of the term of this patent subsequent to May 5, 2004 has been disclaimed.

[21] Appl. No.: 27,799

[22] Filed: Mar. 19, 1987

[51] Int. Cl.[4] ..... B25B 7/04

[52] U.S. Cl. ..... 81/409.5; 81/413; 81/318

[58] Field of Search ..... 81/318, 319, 320, 321, 81/324, 407, 408, 409, 409.5, 411, 412, 413, 414

[56] References Cited

U.S. PATENT DOCUMENTS

| | | | |
|---|---|---|---|
| 1,106,518 | 8/1914 | Matti | 81/320 |
| 1,534,218 | 4/1925 | Jones | 81/320 |
| 2,066,716 | 1/1937 | Cruickshank | 81/411 |
| 4,304,158 | 12/1981 | Brunosson et al. | 81/427.5 |
| 4,651,598 | 3/1987 | Warheit | 81/407 |
| 4,662,252 | 5/1987 | Warheit | 81/341 |

FOREIGN PATENT DOCUMENTS

| | | | |
|---|---|---|---|
| 1060330 | 6/1959 | Fed. Rep. of Germany . | |
| 67463 | 2/1914 | Switzerland | 81/411 |

*Primary Examiner*—Frederick R. Schmidt
*Assistant Examiner*—Maurina Rachuba
*Attorney, Agent, or Firm*—Atwell, George C.

[57] ABSTRACT

In a plier-type tool having the capability to automatically slidably adjust, in response to manual closing of its handle ends, to the size of any workpiece or other item to be gripped which is within the size range defined by the maximum opening between the tool jaws, certain structural and functional improvements are provided which are intended to simplify and reduce the costs of manufacturing of the tool and to enhance its appearance and performance.

23 Claims, 4 Drawing Sheets

PLIER-TYPE TOOL

BACKGROUND OF THE INVENTION

This invention pertains generally to a plier-type tool somewhat similar in purpose and appearance to those in the prior art known as water pump pliers or slip-joint pliers. The invention more particularly pertains to an automatic slip-joint plier-type tool which will slidably adjust to, and then pivotally grip against, any workpiece the size of which is within the range of the tool's jaws.

Heretofore, two U.S. patents which disclose an automatically self-adjusting plier-type tool. In U.S. Pat. No. 4,651,598, the basic structure and function is disclosed for self-adjusting utility pliers which, by one-hand manipulation, automatically slide the lower jaw relative to the upper jaw to contact the workpiece whereupon the sliding action of the lower jaw converts to a pivoting action to exert positive gripping force against the workpiece as continued manual pressure is exerted against the tool's handle ends. In U.S. Pat. No. 4,662,252, improved alternative embodiments are disclosed for the construction of such a tool at significantly reduced cost.

While the tools and the features thereof which are described and illustrated in the aforementioned patents constitute a significant contribution to the art of tools and instruments, further experimentation and development relating to the basic operational concept in a self-adjusting plier-type tool have led to the conception of significant cost saving and operational improvements as herein disclosed.

The basic operating principle of the automatic self-adjusting plier tool is first disclosed in the aforementioned U.S. Pat. No. 4,651,598, wherein the basic tool structure includes two rigid body members movably joined at their neck portions in a scissors-like arrangement to be, during the use of the tool, both slidable and pivotable relative to each other. These body members have angled jaw ends in opposed relation which constitute the working end of the tool and handle ends constituting the gripping end of the tool. The structure of the tool which enables the self-adjusting function by one-hand manipulation includes an elongated slot in the neck portion of the major body member, and a fastener or pivot post projecting from a fixed position on the neck portion of the minor body member and extending through the elongated slot of the major body member.

For general reference and an understanding of this disclosure, the major body member of the self-adjusting tool can be referred to as member A, and the minor body member, from which the pivot post projects, can be referred to as member B. Accordingly, in the aforementioned basic U.S. Pat. No. 4,651,598, one means of attaining the necessary biasing function that normally causes the jaws to slide open is the provision of a wire compression spring disposed longitudinally on member A to exert a pushing force against an end of the control arm and thereby cause member B to slide relative to member A. Although the use of the aforementioned arrangement sufficiently demonstrates the self-adjusting principle, it was found in the early development of the tool that a more positive action could be obtained by enhancing the biasing means through the addition of a spring carried on member B which is adapted to exert a secondary force on the control arm to normally cause the control arm to pivot on member B toward the jaw end of the tool whereby the sliding opening action becomes a motion of member A relative to member B.

Then, the primary purpose of the longitudinal compression spring on member A is to effect a translation of force through the control arm, when the jaw ends contact a workpiece, to shift the pivot post on member B laterally in the longitudinal throat portion slot of member A whereby the pawl or camming member carried on the pivot post engages along a long edge of the slot. Hence, the longitudinal spring functions to convert the jaw-closing sliding action, upon workpiece contact, to a continuing jaw-rotating or pivot action between the joined body members.

Subsequent to the development of the operating principle for the self-adjusting plier-type tool, various arrangements for the biasing means were devised, utilizing springs of different configurations and location to provide the necessary forces between the members A and B through the interconnecting control arm. One purpose in altering the biasing means arrangement was to place the spring components fully inboard in a concealed and protected disposition while increasing the operating efficiency of the tool. Different problems were encountered in spring selection and securement in obtaining the desired biasing function, depending on whether the members A and B were to be solid, drop-forged members or stamped and shaped from relatively thin sheet metal.

SUMMARY OF THE INVENTION

The present invention comprehends, in a plier-type tool of the type heretofore generally described, the provision of certain novel structural features and improvements, some of which contribute to simplification or reduction in the cost of manufacturing, some of which improve the operation of the tool, some of which improve the appearance and marketability of the tool, and some of which effect all of the foregoing. Such features and improvements can be broadly categorized as follows:

(i) an improved means for obtaining the automatic opening action of the tool's jaws, including specific components of a biasing means which participates in accomplishing such function;

(ii) resilient injection molded plastic grips of novel design which not only enhance the appearance of the tool but contribute to simplification and reduced costs in manufacturing;

(iii) a means positively assuring that a pawl component of the tool will not be prone to "hang up" regardless of orientation of the tool during use;

(iv) to hold the tool's jaws and handles in a fully closed position for storage of the tool, a locking means which rapidly responds to inertia in achieving its locking and releasing actions and which may be further selectively adapted for manual manipulation without defeating the inertia-responsive feature;

(v) for adaptation of the tool for a special purpose use, such as a medical instrument incorporating the tool's basic function, a normally locked but manually releasable means holds the tool's jaws in a predetermined position;

(vi) the tool's automatic adjustment function is improved by provision of certain structural characteristics in a series or pattern of teeth which coact between the tool's pawl and one of the major body members of the tool; and (vii) in an improved version of a self-adjusting plier-type tool, a simplified and comparatively more efficient means for biasing the jaw ends to their fully opened disposition.

Other features and characteristics of the invention herein disclosed will be understood and appreciated from the ensuing detailed description when read with reference to the various figures of the accompanying drawings.

DETAILED DESCRIPTION OF THE PREFERRED EMBODIMENTS

Although the tools illustrated in the various figures of the accompanying drawings relate primarily to self-adjusting utility pliers which would find use for the same purposes as slip-joint pliers of the prior art which require two-handed adjustment to achieve repositioning of the jaws, it should be observed that the functional concepts of the disclosed tool can be incorporated into special purpose tools without departing from the scope of the invention. Other jaw configurations designed for specific applications can b utilized in a tool incorporating the unique functional characteristics of the tool herein disclosed. Handle size and shape may be varied as may the basic materials from which the tool is constructed. It has, for example, been determined that a plier-type medical instrument, utilizing the self-adjusting and locking features of the disclosed tool, would be of great advantage to a surgeon in grasping bone or implant hardware. The value of a medical instrument capable of grasping and automatically adjusting to "workpiece" size by one-hand manipulation is obvious. It is a further distinct advantage to have such an instrument remain gripped or locked onto the grasped object and stay in position when the surgeon's hand is temporarily removed from the instrument. Such an instrument would necessarily have to be constructed from non-corrosive materials able to withstand repeated autoclave sterilization. An engineer skilled in the art would have little difficulty in designing a highly versatile instrument incorporating the major structural and functional features of the tool herein disclosed whereby it would meet the necessary criteria for medical use. The present invention can be further adapted for other special uses and purposes and it is intended that such adaptations or equivalent variations be included in the scope of the appended claims defining the invention.

Figure 1:
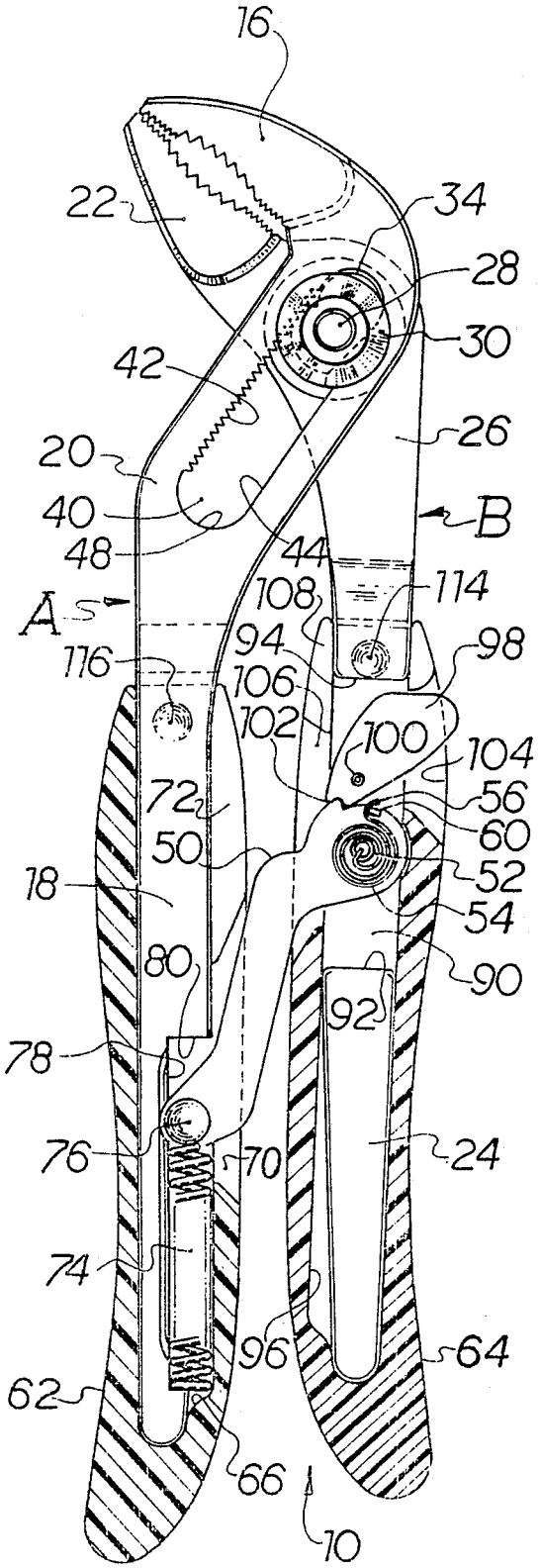
FIG. 1 is a side elevational view of a presently preferred embodiment of a plier-type tool in accordance with the present invention, with certain components thereof shown partially cut away to better illustrate certain aspects of the invention structure which would normally be concealed from view.

With respect to the embodiments of the plier-type tool illustrated in the accompanying drawings, FIG. 1 shows a tool 10 having first and second rigid elongated body members A and B. The body member A has a jaw end 16, a handle end 18, and an intermediate neck portion 20. The body member B, similarly, has a jaw end 22, a handle end 24, and an intermediate neck portion 26. The two body portions A and B are joined at their neck portions by fastening means enabling the body portion A to successively slide and pivot, as hereafter described, relative to the body member B.

The fastening means includes a pivot post 28 and a pair of oppositely disposed nuts 30 (only one of which is shown in FIG. 1) which are threadably secured onto the post 28. Pivot post 28, between the pair of nuts 30 affixed to its opposite ends, projects through an accomodating hole 32 (see FIG. 9) provided in the neck portion 26 of the body member B and thence through a pawl 34 by means of an aperture or hole 36.

An elongated opening or slot 40 is provided in the neck portion 20 of body member A, and pawl 36 is operatively retained in the slot 40. The slot 40 is defined by oppositely disposed long edges 42 and 44 terminating at the outer end in an arcuate edge portion 46 and at the opposite or inner end in an arcuate edge portion 48.

At an intermediate position between the point of jointure of the neck portions 20 and 26 and the distal ends of the handle ends 18 and 24, a rigid control arm 50 extends from one body member to the other and has a first end pivotally connected to body member B on a fixed arbor 52. A wound coil spring, formed from a ribbon of spring steel, is mounted on the arbor 52 and has an inner end fixed in a transverse slot of the arbor 52. The spring 54 has an outwardly turned outer end 56 engaged against a post 60. The post 60 is an integral extension of the control arm 50 and projects therefrom parallel to the arbor 52. The opposite end of the control arm 50, positioned downwardly in FIG. 1, is slidably secured to the body member A as hereafter further described.

Figure 6:
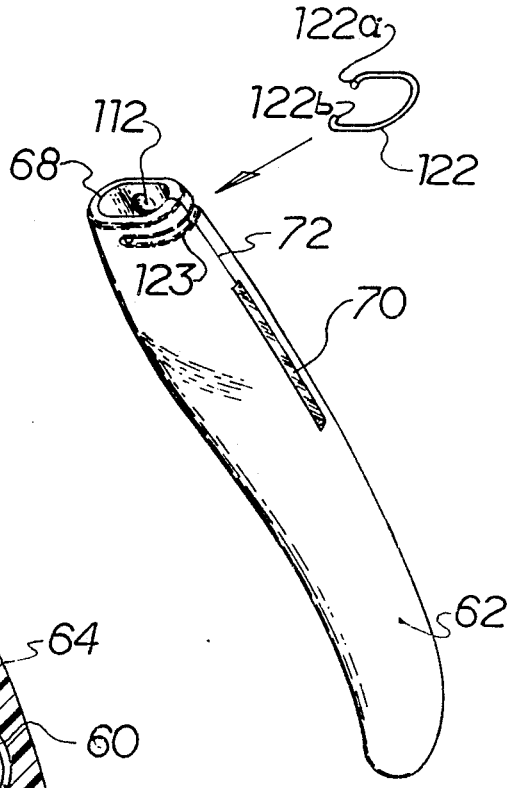
FIG. 6 is a perspective view of a modified version of a component of the tool first shown in FIG. 1.

FIG. 1 further illustrates that the tool 10 is provided with grip members 62 and 64 affixed respectively to the handle ends 18 and 24. The grip members are preferably injection-molded from a thermoplastic material to have the characteristics of semirigidity or limited flexibility and a reasonably high friction characteristic on the outer surface to enhance retention of the tool in the hand of the user. Grip 62 is provided with a central longitudinal cavity 66 which terminates at one end as an opening 68 as shown in FIG. 6. A further opening from the cavity 66 out through the sidewall of the grip member 62 is provided by a longitudinally extending slot 70 which narrows to a closable slit 72 which extends between the slot 70 and the opening 68. The cavity 66 serves as a socket into which the handle end 18 is insertably installed along with a wire compression spring 74. The control arm 50, at its lower end shown in FIG. 1, projects through the slit 70 and cannot withdraw through the slit because of a ball bearing 76 mounted in an accommodating hole at the control arm end.

Figure 3:
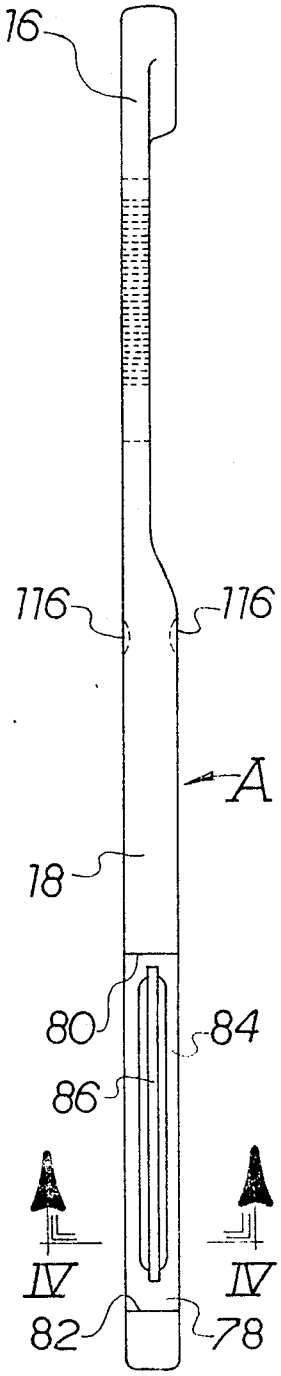
FIG. 3 is a side elevational view of one major body member of the tool first shown in FIG. 1.
Figure 4:
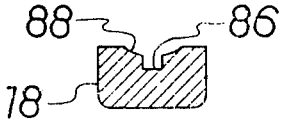
FIG. 4 is a cross-sectional enlarged view taken along lines IV—IV of 3.

It will be noted in FIG. 1 that the handle end 18 is provided with a channel-like recess 78, the ends of which are defined by abutments 80 and 82. FIGS. 3 and 4 illustrate details of the preferred structure and configuration of the handle end 18 which facilitates sliding motion of the end of the control arm 50 which is operatively secured within the channel 78. The channel 78 has a longitudinally extending surface wall 84 into which a narrow tracking channel 86 is recessed. The long edges of the tracking channel 84 are cut away in a radius 88. The radius 88, on the long edge of each side of the slot 86, conformably registers with the outer circumference of the ball 76 shown in FIG. 1, and the tip of the control arm against the ball is slidably guided in the slot 86.

The body member B has a recessed area 90 which extends longitudinally from an abutment 92 to an abutment 94. The recessed area 90, in combination with a cavity 96 within the grip member 64 constitutes an internal pocket wherein the end of the control arm 50, the spring 54, and a pivotal lock button or member 98 are mounted. The member 98 is secured for pivotal movement on a pin 100, and coacting teeth 102 on the control arm 50 and the member 98 act to releasably lock the body members A and B in the position shown in FIG. 1 whereby the jaw ends 16 and 22 are substantially closed. The member 98 functions as a means of locking the tool in a closed disposition for storage in a toolbox or holster when the tool is not in use.

The member 98 is not critical to use of the tool and may be included in the structure if the aforedescribed locking feature is desired. To enable the member 98 to project outwardly beyond the outer surface of the handle 64, for manipulation by the thumb of the user, a slot 104 is provided in the grip member 64. If the member 98 is not provided on the tool 10, then the slot 104 can be eliminated whereby the plastic grip members 62 and 64 can be identically formed, with grip member 64 having an inwardly-facing, longitudinally-extending slot 106 identical to the slot 70 in grip member 62. The configuration of the cavities 66 and 96 within the grip members 62 and 64 can also be identical, thus eliminating the need and related expense of molding a differently shaped grip member for each body member of the tool.

Each grip member 62 and 64 is designed to slide in place on the respective handle ends 18 and 24 after the other illustrated components of the tool have been fully assembled. Hence, grip 64 is provided with a slit 108 extending from the slot 106 to the grip's open end, similar to the slit 72 of the grip 62. These slits enable the grip members to be temporarily deformed by spreading the slit open to enable each grip members to be slidably installed onto its related handle member when the control arm 50 is in its installed position whereupon each slit is closed by pressing the grip member sidewalls inwardly. The slits 72 and 108 may be permanently cemented in place or, alternatively, means may be provided to releasably lock each slit in the closed position. Alternative means for the foregoing purpose are illustrated in FIGS. 5 and 6.

Regardless of whether the grip members 62 and 64 are secured on their related handle ends in a permanent or removable manner, a retaining means must be provided to fix each grip member in its mounted position and prevent its longitudinal shifting. A presently preferred means of accomplishing this objective is the provision of oppositely disposed inwardly projecting integral bosses 110 (FIG. 5) and 112 (FIG. 6) on the inside surface of the grip member cavity, adjacent the cavity open end, as shown in FIGS. 5 and 6. Conformably shaped recesses or dimples 114 and 116 are provided on each flat side of each body member A and B, as shown in FIG. 1, to register with the bosses and anchor the grip members in position.

Figure 2:
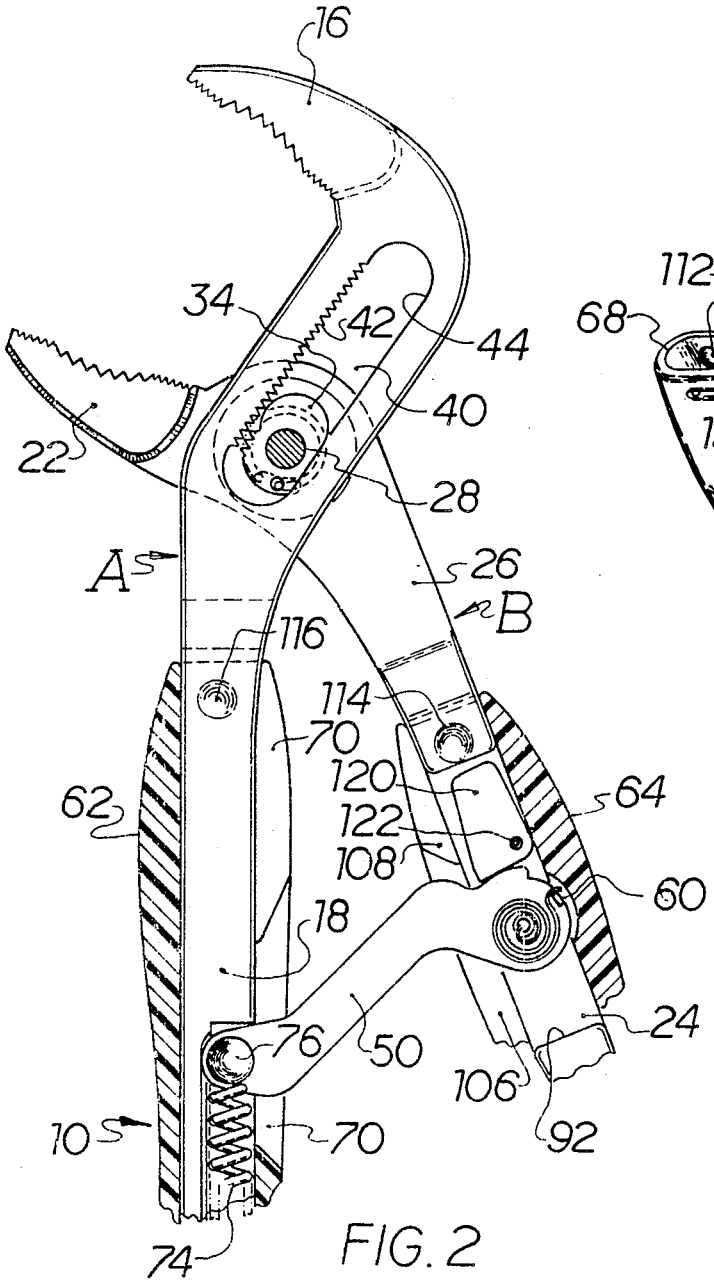
FIG. 2 is a partial side elevational view of the tool first shown in FIG. 1 put illustrating reorientation of certain components of the tool in accordance with its use and operation.

FIG. 2 illustrates the normal, ready to use disposition of the tool 10 and the relative orientation of its various components. Further, FIG. 2 differs from FIG. 1 by its illustration of an alternate means of selectively locking the tool in the fully closed position. On the body member B in FIG. 2, a pivotally-mounted locking member 120 is relatively loosely secured to pivot on a pin 122 and is totally enclosed and hidden within the grip member 64. Both the member 98 shown in FIG. 1 and the pivotal member 120 shown in FIG. 2 are designed to be inertia-responsive to obtain their locking interaction with the control arm 50 to lock the tool in the jaws-closed disposition or to release the locking action. When it is desired to lock the tool in the jaws-closed disposition, the user simply applies a closing force with one hand gripping the handle ends, whereby the handle ends are closed toward each other to cause the jaws to come fully together. Then the user simply rotates the tool forwardly in a short, quick action through a vertical plane by wrist action (in a direction that would be clockwise as viewed in FIG. 1). When the tool is abruptly stopped, the locking member (either the locking button 98 or the member 120) continues forward or clockwise by inertia and thus engages the tooth 102 of the control arm 50. Thereafter, release of the manual force on the handle ends permits the force of the spring 52 to jam the tooth 102 tightly against the pivotal member. A reverse manual action is applied to automatically unlock the tool from the closed disposition. A renewal of squeezing force on the handle ends will sufficiently offset the force of the spring 54 whereby quick wrist action, causing the jaw end of the tool to flick backwardly or counterclockwise as viewed in FIG. 1, frees the pivotal member to pivot rearwardly relative to the body member on which it is pivotally secured and automatically disengage from the tooth 102 of the control arm 50. Whereas the pivotal member 120 shown in FIG. 2 is strictly inertia-responsive to cause it to lock and release relative to the control arm 50, the pivotal member 98 shown in FIG. 1 is designed to permit manual operation as well.

Figure 5:
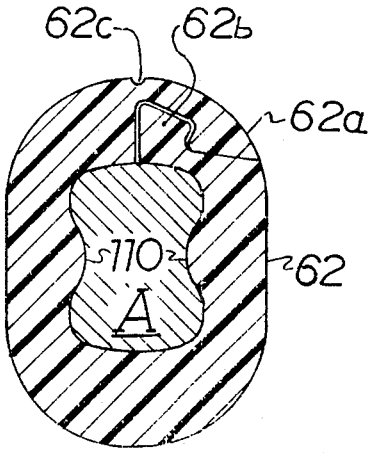
FIG. 5 is a cross-sectional enlarged view of a grip member component of the tool first shown in FIG. 1.

As heretofore mentioned, FIGS. 5 and 6 show alternative means for completing the attachment of the grip members 62 and 64 in their operative positions by closing the slit 72. The structure shown in FIG. 5 contemplates the provision of a grip member 62 having a tongue portion **62*a* which would interlock with a ridge portion 62*b* provided in the grip member adjacent the slit 72. In this form of the grip member, the slit 72 would not extend directly outwardly and open on the surface of the grip member, as shown in FIGS. 1 and 2. The tongue portion 62*a* would be flexed outwardly at a hinge point 62*c* whereby the end of the grip member, during installation, could pass over the installed control arm 50. Thereafter, the tongue portion 62*a* would be snapped in place over the ridge portion 62***b* to removably fasten the slit 72 in closed abutment.

In the alternative form of the grip member 62 shown in FIG. 6, a U-shaped spring wire clip 122, having inwardly-directed integral legs 122*a* and 122*b*, is shaped to be conformably received in a groove 123 adjacent the open end of the grip member 62. At opposite ends of the groove 123, small holes are provided through the sidewall of the grip member to receive the legs 122*a* and 122*b* when the clip 122 is snapped into installed position within the groove 123. Both forms of the closures shown in FIGS. 5 and 6 permit removal of the grip member from the tool; the clip 122 in FIG. 6 can be sprung out of the groove 123 to allow the sidewalls of the grip member to spread at slit 72, and the tongue 62*a* shown in FIG. 5 can also be snapped open and hinged outwardly to open the slit 72.

Figure 7:
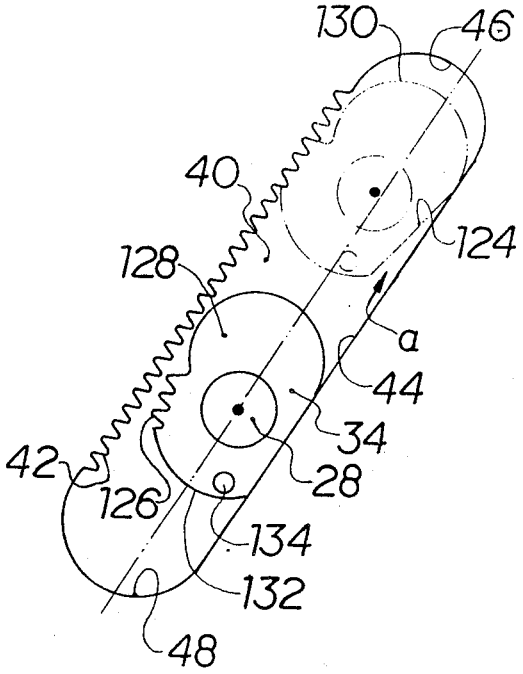
FIG. 7 is an enlarged schematic representation of an area of the tool first shown in FIG. 1 wherein two major body portions of the tool are fastened for successive slidable and pivotal action relative to each other.

FIG. 7 schematically illustrates, in an enlarged view, the configuration and layout of the elongated slot 40 shown in FIGS. 1 and 2. Although only one pawl or camming member 34 is utilized for operational interaction within the slot 40, two different operative positions of the pawl 34 are shown in FIG. 7 to enable clarity of explanation. The pawl 34 has a straight back edge 124; an oppositely-disposed or forward tooth portion 126, an adjacent arcuate camming edge 128, and outer or upper arcuate end 130, and a lower arcuate end 132. The pawl 34 is pivotally secured on the post or fastener 28 to be slidably movable within the slot 40 and to pivot between a first position wherein the back edge 124 slides against the slot's tracking surface 44 and an engaged position wherein the tooth portion 126 meshes with teeth of the toothed boundary edge which constitutes a track 42.

As compared to self-adjusting plier-type tools first reduced to practice, it has been determined that an increase in the number of teeth provided along the track 42 and a reduction in tooth length or protrusion significantly improves the operational efficiency of the tool, particularly when the pivotal arc or angle of pivotal movement of the pawl is sufficiently minimized. During the use of a self-adjusting plier-type tool constructed in accordance with this disclosure, when the closing jaw ends contact a workpiece between them, the translation of forces in the tool s biasing means causes the pawl 34 to pivot from its disengaged position to its engaged position with the track 42. There is a corresponding slight lateral shifting of body member B relative to body member A such that pawl 34 shifts laterally a slight distance relative to slot 40, as shown in FIG. 7. This lateral shifting can be immediately appreciated by observation of the relative position of the center point of post 28 when the pawl 34 is in its first and second operating positions relative to a longitudinally extending phantom line provided for reference in FIG. 7. This line is parallel to the back edge or guiding surface 44 of the slot 40 and extends through the center point of post 28 when the pawl 34 is in its slidable position and out of engagement with the track teeth. It will be noted that the center point of the post 28, as viewed in FIG. 7, has shifted to the left as a function of the pawl 34 pivoting to its tooth-engaged position.

The provision of relatively short teeth on the track 42 and the pawl 34 result in a greater number of teeth per unit length along the track 42 of the slot 40 and a reduction in the distance the pawl 34 must move laterally to have its camming face 128 contact the track and thereby cam the pawl to pivot from the disengaged to the engaged position. The increased number of teeth on the track 42, resulting from a comparative reduction in size, provides a corresponding increase in the number of engaged positions for the pawl 34 to assume along the length of the slot in relation to various size workpieces to which the tool may be applied. In order to best utilize known manufacturing techniques and, neverless, reduce the size of the teeth to obtain an optimum number of available positions of engagement between the slot teeth and the pawl, and to avoid operational failure under load at the point of tooth engagement, it has been determined that the presently preferred number of teeth along the track 42 be at least three teeth per quarter-inch of track, and no more than five, with the series of teeth along the track edge obviously being identical in size and configuration. It has further been determined that optimum operating characteristics in the tool are obtained by dimensionally configuring the slot 40 and the pawl 34 such that when the pawl pivots from its fully disengaged position to its engagement with the track 42, as shown in FIG. 7, the angle "a" through which it pivots, as measured between the pawl straight back edge portion 124 and the longitudinally extending guiding surface 44 of slot 40, is within the range of 5° to 10° and, preferably, at approximately 7°.

Figure 8:
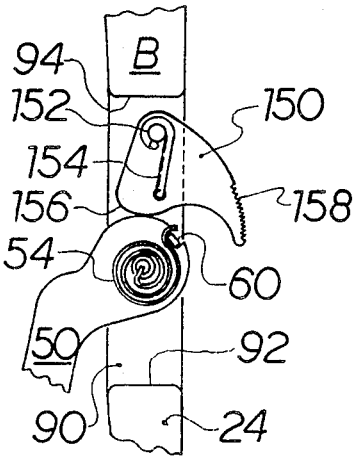
FIG. 8 is a schematic representation of alternative structure which may be incorporated into the tool first shown in FIG. 1.

FIG. 8 is a schematic representation of an optional, normally-engaged, manually-releasable means for arresting relative motion between the body members A and B of a self-adjusting plier-type tool constructed in accordance with the present invention. Although the means shown would be adaptable for use in practically any style of a tool incorporating the self-adjusting principle, the arrangement shown in FIG. 8 relates primarily to the tool first shown in FIG. 1. Specifically, FIG. 8 illustrates a body member B for a tool of the type shown in FIG. 1, having the same biasing means as FIG. 1, including the control arm 50 and the coil spring 54. A pivotal camming member 150 is mounted on a fixed arbor 152 and is urged to normally pivot in a counterclockwise direction, as viewed in FIG. 8, by a wire spring 154. The spring 154 has a coiled end encircling the arbor 152 and is inwardly turned in a slot in the arbor whereby the spring end is fixed against rotation on the arbor. The outer end of the spring 154 is turned inwardly into a small hole in the member 150. The spring 154 urges the member 150 to normally pivot counterclockwise as viewed, whereby its camming edge 156 is normally tightly engaged against the arcuate edge of the control arm 50.

In the use of a tool constructed in accordance with FIG. 8, when the handle ends of the tool are manually squeezed toward each other to grip a workpiece between the tool's jaws, the control arm 50 will pivot on the arbor 52, in a counterclockwise direction as shown in FIG. 8, with the frictional engagement between the outer edge of the end of the control arm 50 against the cam edge 156 causing slight clockwise motion of the member 150 and a slight further tensioning of the preloaded spring member 154. When the jaws of the tool grasp a workpiece and the user releases manual pressure on the handle ends of the tool, the gripping of the jaw ends against the workpiece is maintained through the action of the member 150 locking against the control arm 50 and arresting its further pivotal action to thereby hold the body members of the tool against relative movement. The jaw ends of the tool are thus maintained in gripping relation on the workpiece despite the removal of the user s hand from the tool, and the tool may be selectively released from the workpiece by the user grasping the tool and pressing against surface 558 of member 150 to cause the cam face 156 to move out of engagement with the edge of the control arm 50. The aforedescribed normally-engaged and manually-releasable mechanism for arresting and automatically holding the jaws of the tool in a predetermined position is a feature particularly suited to an instrument embodying the automatic self-adjusting principle where, for example, a surgeon wishes to leave the instrument temporarily engaged in position n bone or hardware while freeing his hands for other procedures.

Figure 9:
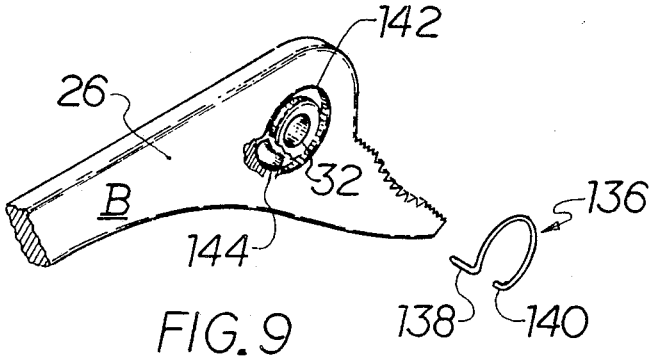
FIG. 9 illustrates a preferred embodiment of a spring member and the means for its securement for utilization in the tool first shown in FIG. 1.

FIG. 9 shows the presently preferred form for a means operatively engaged to the pawl 34 of tool 10 (FIGS. 1 and 2) which acts to normally urge the pawl out of contact with the track 42 of the slot 40. A semicircular or arcuate wire-formed spring 136 has turned first and second ends 138 and 140. Provided in the outer face of body member B, surrounding the opening or hole 32 for the fastener 28, is an annular recess 142. A small arcuate, kidney-shaped opening 144 is provided through the handle member B, extending from the floor of the recess 142 to the inside surface of handle member B. The spring member 136 is configured to reside in the recess 142 whereby the leg 138 projects through the aperture 144 and, thence, through a hole 134 in the pawl 34 (FIG. 7). The leg 140 of the spring member 136 also extends into the aperture 144 but does not project beyond the inside surface of the body member B. The recess 142 is of sufficient width to permit flexure of the spring member 136 during operation of the tool. In its normal position, the spring member 136 applies a slight force to the pawl 34 to hold the pawl in its disengaged position, with its straight edge portion 124 firmly against the slot edge or guiding surface 44. In the use and operation of the tool, this holding force applied to the pawl by the spring 136 is overcome when the pawl pivots to its tooth-meshing position, however, immediately upon release of manual force from the handle ends of the tool, the spring member 136, which was flexed and slightly deformed during the application of the tool to a workpiece, assumes its original state and thereby positively pulls the pawl in counterclockwise pivotal movement as viewed in FIG. 7, back to its fully disengaged position.

The provision of spring member 136 is not an absolute requirement in the structure of the tool 10 inasmuch as pivotal disengagement of the pawl teeth from the track teeth is caused by camming action between the back edge portion 124 of the pawl and the longitudinal guiding surface 44. Specifically, this camming effect occurs in the area where the back edge portion 124 merges with the arcuate edge portion 130 of the pawl 34 (FIG. 7). It has, however, been determined that in certain configurations of the disclosed tool, the pawl 34 can briefly "hang up" in its engaged position, if the spring member 136 is not employed, particularly if the tool during use is oriented with its jaw end pointing directly downward. Although such binding or "hang up" occurs quite infrequently and can be immediately dislodged through slight handle end manipulation, provision of the spring member 136 to function as heretofore described will positively prevent such binding action.

Figure 10:
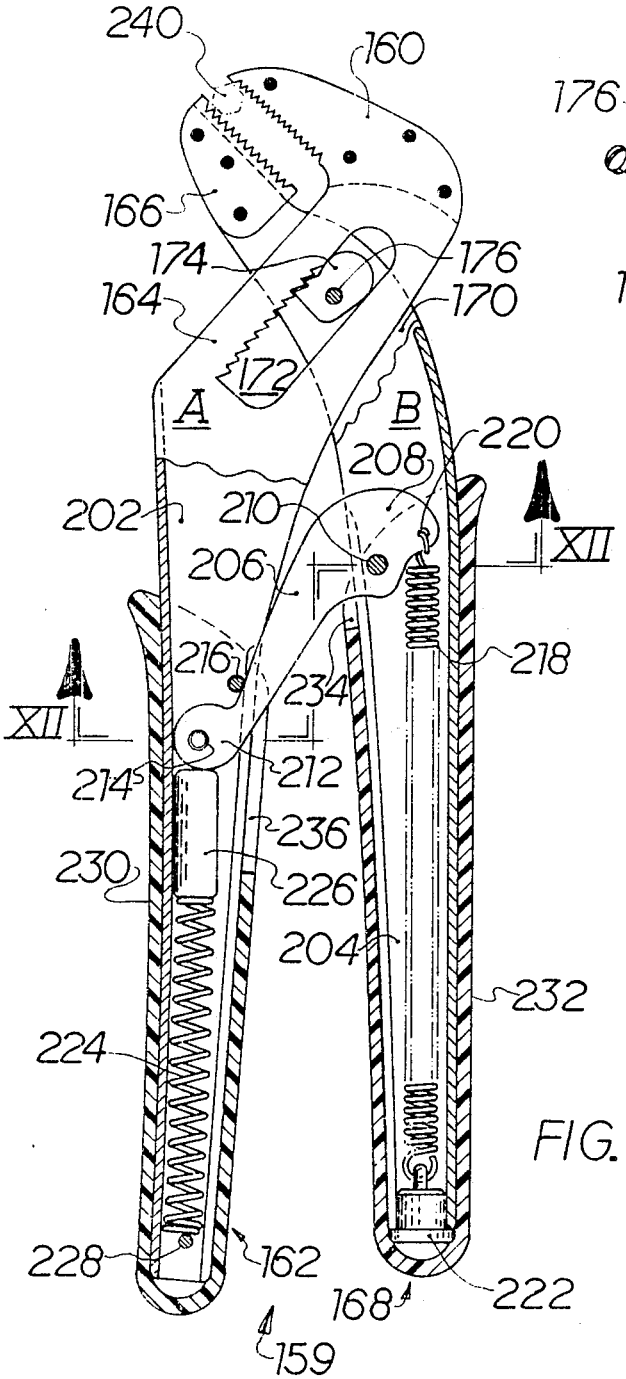
FIG. 10 is a side elevational view, partially cut away, of an alternate form or structure of a tool in accordance with the present invention.
Figure 11:
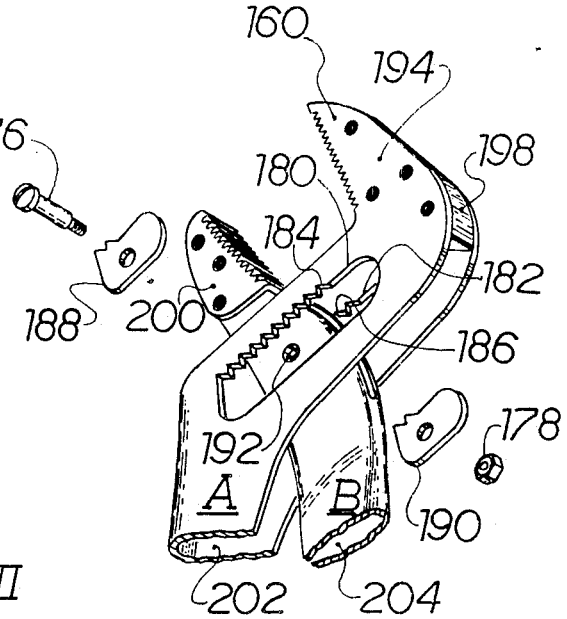
FIG. 11 is an exploded perspective view of part of the tool shown in FIG. 10.
Figure 12:
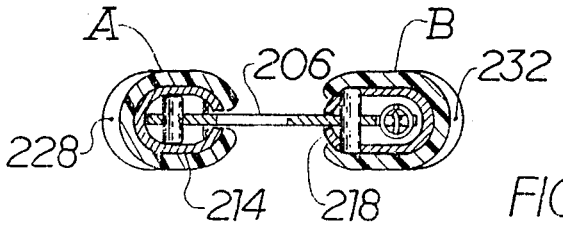
FIG. 12 is a sectional view taken on lines XII—XII of FIG. 10.

FIGS. 10, 11, and 12 illustrate a modified embodiment of a self-adjusting plier-type tool constructed in accordance with the present invention. An entire tool 159 is shown in FIG. 10, with handle end components cut away to reveal internal structure. The tool 159 includes body members A and B operatively interconnected in substantially the same manner as shown with respect to tool 10 in FIG. 1. Body member A of tool 159 has a jaw end 160, a handle end 162, and a throat portion 164. The member B of tool 159 has a jaw end 166, a handle end 168, and a throat portion 170. Member A is provided, in its throat portion, with an elongated slot means 172 adapted to functionally operate with a pawl means 174 pivotally mounted by a fastener 176 to the throat portion of member B. The fastener 176 is shown in FIG. 11 as constituting a bolt threaded to engage a nut 178.

Tool 159 is formed with its major body parts stamped and folded from flat sheet metal whereby the body member A has spaced-apart matching longitudinal slots 180 and 182 which constitute a track or slot means 172. One long edge of each of the slots 180 and 182 have matching teeth series 184 and 186. The pawl means 174 includes a pair of identical pawls 188 and 190 for operatively engaging the respective series of teeth 184 and 186. The pawls 188 and 190 are held in operative position in registration with opposite side surfaces of the throat portion of body member B by the provision of hole 192 shown in FIG. 11.

Jaw end 160 of member A is a laminated structure, having parallel sidewall portions 194 and 196 separated by and spot-welded to an intermediate spacer member 198. The jaw end 166 of member B is also of double wall construction and has a saddle member 200 spot-welded in position to present a serrated jaw surface having a width equivalent to the opposite serrated surface of jaw end 160.

FIG. 11 shows that the body members A and B are formed to define longitudinally extending cavity areas 202 and 204 which are open inwardly toward each other for the full length of the handle ends 162 and 164. A control arm 206 extends between the body members A and B, as shown in FIG. 10, and has a first end extending into the cavity 204 and pivotally secured by a crosspin 210 which extends through the opposite sidewalls of the body member. The second or lower end of the control arm 206, as shown in FIG. 10, extends into the cavity 202 of body member A and is disposed to slide in a longitudinal path, the upper end of which is defined by a stop means or crosspin 216 anchored firmly in the spaced-apart sidewalls of the body member A.

In handle end 168 of body member B, an extension spring 218 is mounted in the space or cavity 204 to exert a pulling force between a stationary end plug 222 and a point 220 on the first or upper end 208 of the control arm 206.

Contained within the handle end 162 of the tool 159 in FIG. 10 is a compression spring 224 which extends longitudinally between a slidable plug 226 and a fixed crosspin 228. The spring 224 exerts a constant pushing force against the plug 226 which is translated to the end 212 of the control arm 206.

The structure of the tool 159, particularly as shown in FIGS. 10 and 12, is completed by the provision of grip members 230 and 232 on respective handle ends 162 and 168. Grip member 230 has an upper end side slot 236 through which the lower end 212 of the control arm 206 extends. The length of slot 236 substantially defines the length of the path of slidable movement of end 212 of the control arm relative to body member A during use of the tool. Grip 232 has a relatively short slot 234 at its upper end to permit the pivotal motion of end 208 of the control arm 206.

The tool 159 shown in FIG. 10 has its various components oriented as though the tool is being held in the hand of a person using it to grasp a nut 240 shown between the jaw ends 160 and 166. Here, the jaws 160 and 166, which would normally be at their fully opened position prior to application of the tool on a workpiece, have moved toward each other until stopped by their contact with the nut 240. The pawl means 174 is shown engaged to the teeth of the slot means 172 following the camming action which caused the pawl to pivot from its normally disengaged disposition. Upon release by the user of manual force on the handle ends of the tool, the force of spring 224 will translate through the control arm 206 and cause member B to move slightly upwardly and to the left as shown in FIG. 10 whereby the pawl means 174 will be cammed counterclockwise out of its engaged position. Then, the spring 218 will cause control arm 206 to act as a lever arm, utilizing pivot pin 210 as a fulcrum to thrust the opposite end of the control arm upwardly against pin 216 whereby member A will slide on member B at their throat portion jointure, and slot means 172 will move relative to the pawl means 174 until the pawl means is located at the lowermost end of the slot means 172.

Although the presently preferred embodiments for a self-adjusting plier-type tool have been described with some particularity, it is to be understood that other embodiments or variations may be introduced without departing from the spirit of the invention or the scope of the appended claims.

We claim:

1. A plier-type tool for automatically gripping workpieces of different sizes, comprising:

first and second rigid elongated body members each having a jaw end, a handle end, and an intermediate neck portion;

slidable and pivotable fastening means connecting the body members between their neck portions and permitting the jaw ends to move toward each other in a sliding action in response to an initial manual force being applied to close the handle ends toward each other to grasp a workpiece between the jaw ends;

the fastening means including an elongated slot in the neck portion of a first of the body members and a pawl pivotably secured to the neck portion of the second body member and disposed to slide within the slot;

the fastening means being responsive to the jaw ends contacting the workpiece such that the sliding action is arrested by the pawl pivotally engaging a long edge of the slot and continued manual force on the body members causes a pivoting gripping action of the jaw ends against the workpiece; and means operatively engaged to the pawl which acts to normally urge the pawl out of engage with the long edge of the slot.

2. The tool of claim 1 wherein the means operatively engaged to the pawl is a spring member.

3. The tool of claim 2 wherein the spring member is mounted on the neck portion of the second body member.

4. A plier-type tool for automatically gripping workpieces of different sizes, comprising:

first and second rigid elongated body members each having a jaw end, a handle end, and an intermediate neck portion;

slidable and pivotable fastening means connecting the body members between their neck portions and permitting the jaw ends to move toward each other in a sliding action in response to an initial manual force being applied to close the handle ends toward each other to grasp a workpiece between the jaw ends;

biasing means coacting between the body members, including a wound ribbon spiral spring mounted on one of the body members, for causing the body members to slide relative to each other such that the jaw ends slide to a fully open disposition.

5. The tool of claim 4 wherein the biasing means further includes a rigid control arm extending between the body members, one end of the control arm being pivotally connected to the second body member, and the spiral spring operatively connected to the control arm to normally urge it to pivot and exert a force causing the first body member to slide relative to the second body member such that the jaw ends of the body members move toward an open disposition.

6. A plier-type tool for automatically gripping workpieces of different sizes, comprising:

first and second rigid elongated body members each having a jaw end, a handle end, and an intermediate neck portion;

slidable and pivotable fastening means connecting the body members between their neck portions and permitting the jaw ends to move toward each other in a sliding action in response to an initial manual force being applied to close the handle ends toward each other to grasp a workpiece between the jaw ends;

biasing means, including a control arm extending between the body members, coacting between the body members and normally urging the jaw ends to slide away from each other to a fully opened disposition;

the fastening means adapted to halt further sliding action of the body members in response to the jaw ends contacting the workpiece and to then translate the manual force on the handle ends into a pivoting, gripping action of the jaw ends against the workpiece;

an elongated grip member covering each handle end;

each grip member having a longitudinal internal cavity, a first end open to the cavity, and a closed end;

the cavity serving as a socket into which the handle end is insertably contained; and the control arm projecting through the sidewall of at least one of the grip members.

7. The tool of claim 6 wherein each grip member is of semi-rigid plastic construction.

8. The tool of claim 6 wherein at least one grip member is provided with a longitudinally extending slit to accommodate extension of the control arm therethrough and into the cavity.

9. The tool of claim 8 wherein the slit extends along the side of the grip member to the first end, and further including means to releasably lock the slit closed in an area substantially adjacent the first end.

10. The tool of claim 6 further comprising means operative between each handle end and its encasing grip member to retain the grip member in stationary position on the handle end.

11. The tool of claim 10 wherein the retaining means is constructed to be manually released to enable removal of the grip member from the handle end.

12. The tool of claim 6 wherein the biasing means further includes a first spring operatively secured to one of the body members and exerting a force which causes the control arm to pivot, and a second spring operatively secured on the other body member and exerting a linear force on an end of the control arm.

13. The tool of claim 12 wherein the second spring is contained within the cavity.

14. The tool of claim 6 wherein the biasing means includes a wound wire compression spring contained within the cavity defined by one of the grip members.

15. A plier-type tool for automatically gripping workpieces of different sizes, comprising:

first and second rigid elongated body members each having a jaw end, a handle end, and an intermediate neck portion;

the body members being pivotally joined at their neck portions in a scissors-like arrangement whereby the jaw ends are in opposed relation at one end of the tool and the handle ends are in opposed relation at the other end of the tool;

releasable locking means acting between the body members to lock them in stationary relation to each other; and the releasable locking means being inertia responsive to effect its locking and releasing actions.

16. The tool of claim 15 wherein the releasable locking means is adapted to be manually locked and released.

17. A plier-type tool for automatically gripping workpieces of different sizes, comprising:

first and second rigid elongated body members each having a jaw end, a handle end, and an intermediate neck portion;

slidable and pivotable fastening means connecting the body members between their neck portions and permitting the jaw ends to move toward each other in a sliding action in response to an initial manual force being applied to close the handle ends toward each other to grasp a workpiece between the jaw ends;

means normally urging the jaws to a fully open disposition, including a control arm extending between the body members at a position intermediate the fastening means and the distal ends of the handle ends;

the fastening means being responsive to the jaw ends contacting the workpiece and acting to arrest the sliding action such that continued manual force on the handle members causes a pivoting gripping action of the jaw ends against the workpiece;

the control arm having one end mounted to pivot on one of the body members; and manually releasable means on the one body member normally arresting movement of the control arm.

18. The tool of claim 17 wherein the manually releasable means comprises a pivotal camming member having a cam edge surface for engaging against the end of the control arm to arrest its movement, means normally biasing the camming member into engagement with the control arm end to arrest movement of the control arm, and the camming member having a portion projecting outwardly from the body member for manual manipulation to overcome the biasing means and temporarily release the control arm to permit it to pivot.

19. A plier-type tool for automatically gripping workpieces of different sizes, comprising:

first and second rigid elongated body members each having a jaw end, a handle end, and an intermediate neck portion;

slidable and pivotable fastening means connecting the body members between their neck portions and permitting the jaw ends to move toward each other in a sliding action in response to an initial manual force being applied to close the handle ends toward each other to grasp a workpiece between the jaw ends;

biasing means coacting between the body members, including a control arm extending between the body members and secured to pivot on the first of the body members, an extension spring enclosed on the handle end of the first body member which constantly pulls on the control arm to impart pivotal action thereto; and means normally translating the pivotal action of the control arm to the second body member and causing it to slide relative to the first body member such that the jaw ends move apart.

20. The tool of claim 19 further including a compression spring enclosed on the handle end of the second body member and constantly exerting a pushing force on the control arm.

21. A plier-type tool comprising:

first and second rigid elongated body members each having a jaw end, a handle end, and an intermediate neck portion;

fastening means joining the neck portions in a scissors-like arrangement so that the handle ends are in opposed relation at one end of the tool for grasping by the hand of the user, and the jaw ends are in opposed relation at the outer end of the tool;

means operative between the body members and normally urging the jaw ends to slide apart;

an elongated slot in the neck portion of the first body member being partially defined by a toothed boundary edge constituting a track;

a pawl pivotally secured to the neck portion of the second body member and disposed for sliding movement along, and in operative engagement with, the track;

the track having a series of teeth formed therealong, all of which are identical in size and configuration;

the number of teeth on the track being at least three teeth per quarter-inch of track; and the pawl having a plurality of teeth on one edge thereof which are adapted to engage with the teeth of the track when the pawl is caused to pivot.

22. A plier-type tool comprising:

first and second rigid elongated body members each having a jaw end, a handle end, and an intermediate neck portion;

fastening means joining the neck portions in a scissors-like arrangement so that the handle ends are in opposed relation at one end of the tool for grasping by the hand of the user, and the jaw ends are in opposed relation at the outer end of the tool;

means operative between the body members and normally urging the jaw ends to slide apart;

an elongated slot in the neck portion of the first body member being partially defined by a toothed boundary edge constituting a track;

a pawl pivotally secured to the neck portion of the second body member and disposed for sliding movement along, and in operative engagement with, the track;

the track having a series of teeth formed therealong, all of which are identical in size and configuration, and the number of teeth being at least three teeth per quarter-inch of track;

the slot being further defined by a tracking surface opposite the toothed track, the tracking surface being substantially smooth and linear in the direction of the slot's elongation; and the pawl having a toothed section oriented toward the toothed track, an opposite edge oriented toward the tracking surface, and a straight edge portion and an arcuate edge portion for guiding it along the tracking surface during operation of the tool.

23. The tool of claim 22 wherein the arcuate edge portion of the pawl's opposite edge in oriented toward the outer jaw end of the tool; and the straight edge portion is disposed, when the pawl is operatively engaged with the track, at an angle within the range of 5°–10° to the tracking surface.

* * * * *